US007610142B1

(12) United States Patent
Hoard et al.

(10) Patent No.: US 7,610,142 B1
(45) Date of Patent: Oct. 27, 2009

(54) SENSOR SELF-CALIBRATION SYSTEM AND METHOD

(75) Inventors: John William Hoard, South Lyon, MI (US); Robert F. Novak, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/139,301

(22) Filed: Jun. 13, 2008

(51) Int. Cl.
*F02D 41/00* (2006.01)

(52) U.S. Cl. ..... 701/109; 60/274; 73/118.01

(58) Field of Classification Search ..... 701/109, 701/108, 102, 115, 34; 73/118.01, 117.03, 73/1.02; 60/274, 276, 277, 285; 123/568.21, 123/672, 681
See application file for complete search history.

(56) References Cited

U.S. PATENT DOCUMENTS 4,283,256 A 8/1981 Howard et al.
4,532,013 A 7/1985 Dietz et al.
6,076,348 A * 6/2000 Falandino et al. ..... 60/276
6,085,582 A 7/2000 Tripathi et al.
6,131,439 A 10/2000 Hamburg et al.
6,227,033 B1 5/2001 Kainz
6,389,874 B1 * 5/2002 Huff et al. ..... 73/1.02
6,581,571 B2 * 6/2003 Kubesh et al. ..... 123/406.44
6,632,674 B1 10/2003 Warburton
6,789,533 B1 9/2004 Hashimoto et al.
6,820,603 B2 * 11/2004 Yasui et al. ..... 123/672
6,862,915 B2 3/2005 Staphanos et al.
7,249,489 B2 7/2007 Allmendinger
2007/0119172 A1 5/2007 Barbe et al.
2007/0144250 A1 6/2007 Ramsesh

* cited by examiner

*Primary Examiner*—Hieu T Vo
(74) *Attorney, Agent, or Firm*—Diederiks & Whitelaw, PLC

(57) ABSTRACT

A vehicle includes an engine, a booster, an exhaust gas sensor and a self-calibration arrangement for the exhaust gas sensor. When sensor calibration check is desired, a controlling unit opens a valve in order to subject a sensing element of the sensor to a supply of gas having a known gas concentration. Gas concentration signals from the sensor are compared with known concentration values, with the results being used to re-calibrate the sensor. The supply of gas can be received directly from the booster or from an optional reservoir. The invention is particularly applicable for use with a universal exhaust gas oxygen sensor in a vehicle powered by a diesel engine.

20 Claims, 2 Drawing Sheets

SENSOR SELF-CALIBRATION SYSTEM AND METHOD

FIELD OF INVENTION

The invention pertains to the art of motor vehicles and, more particularly, to a sensor self-calibration system used in the exhaust of a vehicle.

BACKGROUND OF THE INVENTION

Due to the increasing government regulation of vehicle emissions, exhaust sensors have been employed to ensure that a vehicle is within emissions standards. To this end, most current gasoline vehicles in the United States incorporate one or more exhaust gas oxygen sensors (EGO). Basically, typical exhaust gas oxygen sensors provide either voltage or current signals dependent on the oxygen concentration in an exhaust stream, with the signals being used as feedback to adjust an operating air/fuel ratio. Furthermore, many diesel vehicle manufacturers and sensor suppliers have begun development toward sensors for nitrogen oxides ($NO_x$), hydrocarbon (HC) and soot in engine exhaust, as well as ammonia ($NH_3$).

Prior to use, an exhaust gas sensor needs to be calibrated. For example, to calibrate an oxygen sensor, a calibration gas containing a mixture of oxygen and other gases having a known concentration of oxygen is applied to the sensor. The measured value of oxygen is compared to the known concentration of oxygen in the calibration gas and a correction factor is calculated. Over time, the sensitivity of an exhaust gas sensor can drift, at least in part because the sensor is exposed to extreme temperatures, debris and water from the exhaust. That is, these sensors are subjected to damage during operation of the vehicle because debris from the exhaust and accumulating soot over time can alter the signal outputs of the sensor. Therefore, to remain accurate, the exhaust gas sensor may require periodic calibration.

To address the above, it would be extremely beneficial to incorporate a self-calibrating sensor system into a vehicle to enable periodic self-calibration of an exhaust gas sensor. More specifically, it would be desirable to employ components already in the vehicle to periodically provide a calibration gas having a known gas concentration to the exhaust gas sensor to test the exhaust gas sensor and make any necessary adjustments to a correction factor established for the sensor. It would be particularly advantageous to provide a system that would enable calibration of an exhaust gas sensor while an engine of the vehicle is running. Finally, it would be desirable to provide protection of the sensor from debris, water and accumulating soot.

SUMMARY OF THE INVENTION

In accordance with the present invention, a system is incorporated into a vehicle that enables an exhaust gas sensor to be periodically self-calibrated, even during operation of the vehicle. The sensor self-calibration system includes the gas sensor arranged in an exhaust passage for the vehicle, a valve interposed between the exhaust gas sensor and a source of calibration gas having a known gas concentration, and a controlling unit. The controlling unit functions to periodically open the valve to deliver calibration gas to the sensor. The controlling unit then receives one or more signals from the sensor based on the known gas concentration and derives a modified correction factor for signals from the sensor. In this sense, the exhaust gas sensor can be periodically calibrated to compensate for sensitivity drifts which develop over time.

In accordance with a preferred embodiment of the invention, the vehicle is provided with an air booster, such as a turbocharger or a supercharger, having an air inlet and multiple air outlets. One of the air outlets is used to direct inlet air to an engine of the vehicle, while another one of the air outlets is connected to the valve of the self-calibrating system. With this arrangement, the controlling unit enables the intake air, which has a known gas concentration, such as 21% oxygen in the case of calibrating an exhaust oxygen sensor, to be selectively delivered directly to the sensor for calibration purposes. In accordance with one preferred embodiment of the invention, the self-calibration system includes an exhaust gas oxygen sensor employed with a diesel engine. In any case, the sensor itself has a body with a bore, a gas inlet tube arranged in the bore, a sensing element coupled to the controlling unit. When the calibration gas is directed to the gas inlet tube through the valve, the sensing element measures the known concentration and sends a signal to the controlling unit. The controlling unit then compares the measured concentration with the known concentration and the sensor is calibrated accordingly for subsequent exhaust gas readings.

Additional objects, features and advantages of the present invention will become more readily apparent from the following detailed description of preferred embodiments of the invention when taken in conjunction with the drawings wherein like reference numerals refer to corresponding parts in the several views.

DESCRIPTION OF PREFERRED EMBODIMENTS

Figure 1:
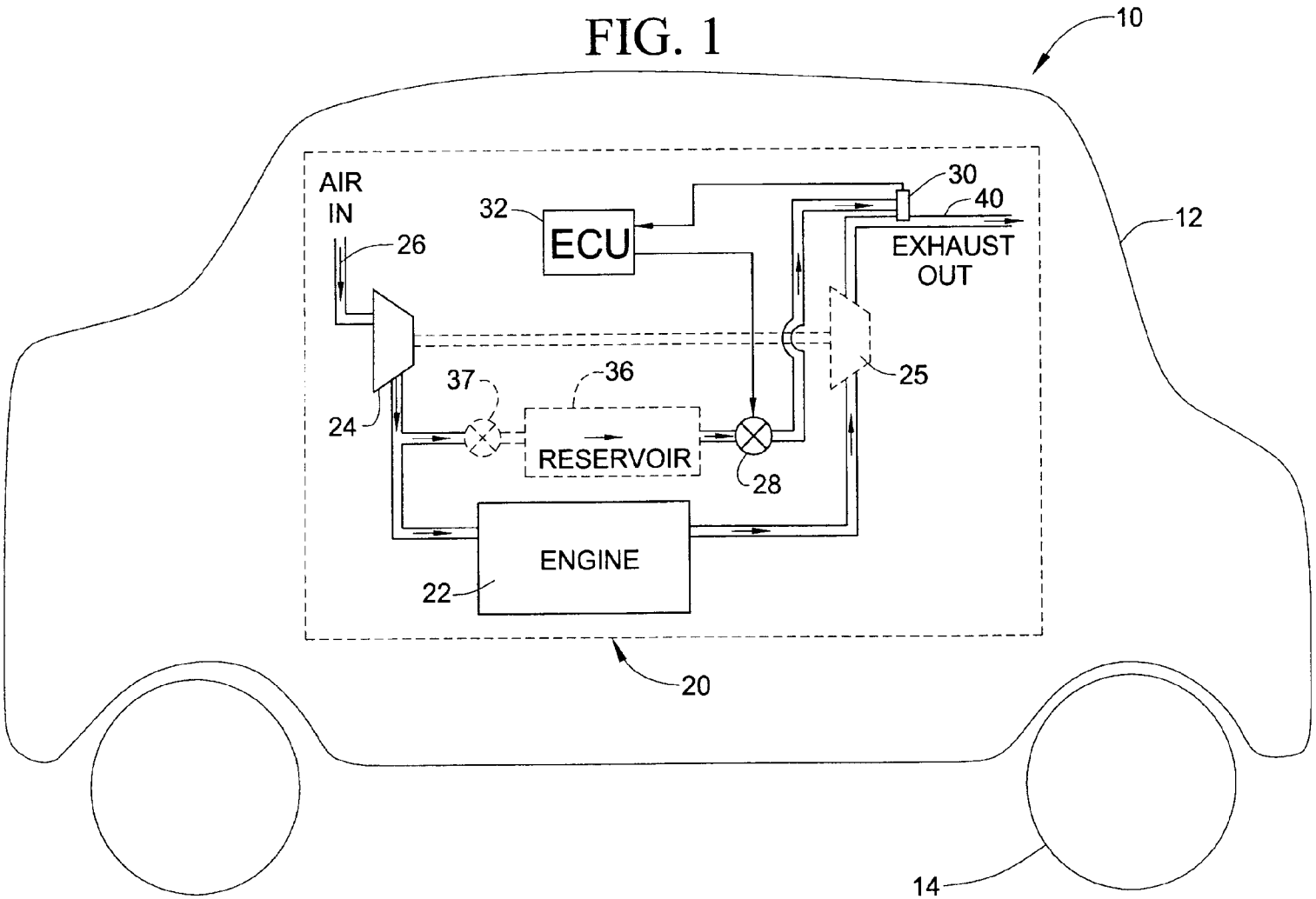
FIG. 1 schematically illustrates a vehicle incorporating a self-calibrating exhaust gas sensor system constructed in accordance with a preferred embodiment of the invention.

With initial reference to FIG. 1, a vehicle 10 is generally shown to include a body 12 supported on wheels 14, with vehicle 10 incorporating a sensor self-calibration system 20 constructed in accordance with a preferred embodiment of the invention. As depicted, vehicle 10 includes an engine 22, particularly a combustion engine connected to a source of fuel (not shown), and a booster 24, such as a turbocharger or supercharger, for directing a flow of intake air 26 to engine 22. In the case of a turbocharger, the booster actually constitutes a compressor 24 connected to a turbine 25 via a shaft (not labeled). In the case of a supercharger, no turbine or associated shaft would be employed. In any case, in a manner widely known in the art, the fuel and air 26 are supplied to and combusted in engine 22, with the products of combustion exhausted from the vehicle. In accordance with the invention, self-calibrating system 20 of vehicle 10 includes a valve 28 interposed in a duct (not separately labeled) providing fluid communication between an air outlet (not labeled) of booster 24 and a sensor 30 which, as will be discussed more fully below, is exposed to the exhaust stream from engine 22. Self-calibration system 20 also includes an electronic controlling unit (ECU) 32 which is electrically connected to both valve 28 and sensor 30 as will also be detailed more fully below. As further depicted in FIG. 1, an optional gas reservoir 36 can be arranged between an air outlet of booster 24 and valve 28, while an additional electronically controlled valve 37 can be provided prior to reservoir 36 to potentially trap gases, in combination with valve 28, for later use. As will be discussed more fully below, this arrangement can also be replaced by an air pump for use in sensor calibration.

At this point, it should be recognized that vehicle 10 can take various forms, such as engine 22 being either a gasoline or diesel engine. In addition, controlling unit 32 need not be dedicated for use with the self-calibration system 20, but preferably constitutes a main ECU for vehicle 10, so as to also control various engine, transmission and other functions.

During normal operation of vehicle 10 with valve 28 closed, booster 24 receives intake air 26 and supplies the air to engine 22 for combustion purposes in a manner known in the art. Exhaust from engine 22 is shown to flow past sensor 30 prior to being exhausted. As discussed above, sensor 30 is pre-calibrated such that signals received by controlling unit 32 have applied thereto a correction factor to establish an actual gas concentration in the exhaust flow from a gas concentration measured by the sensor. To this end, exhaust gas sensor 30 can actually be designed to sense oxygen, nitrogen oxide ($NO_x$), hydrocarbon (HC) and/or soot concentrations in the exhaust produced by engine 22.

Figure 2:
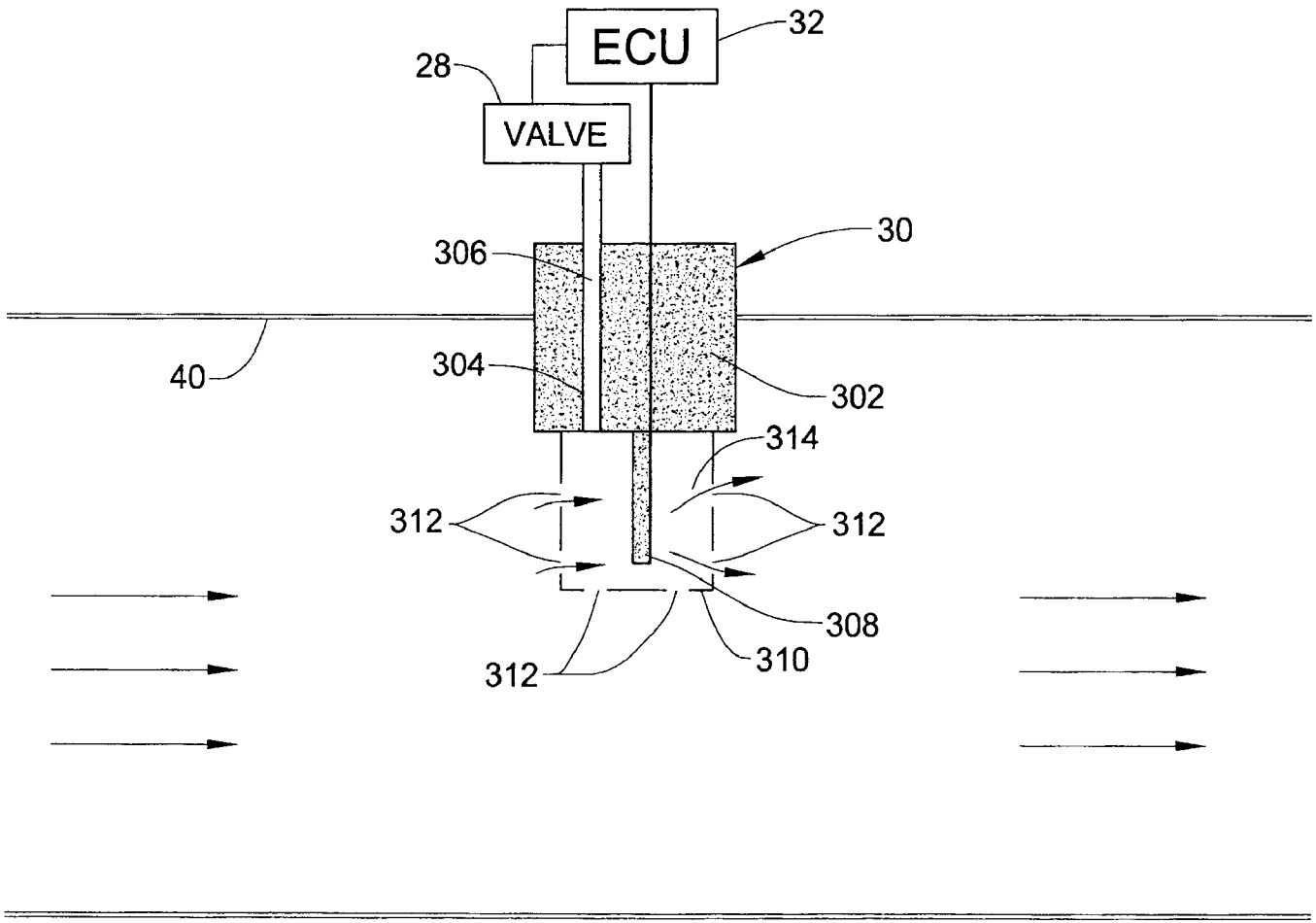
FIG. 2 is a detailed view of a sensor employed in the self-calibrating system of FIG. 1.

A preferred embodiment of the invention is shown in FIG. 2 wherein sensor 30 constitutes an exhaust gas oxygen sensor and, more preferably, an $NO_x$ sensor. As depicted, sensor 30 protrudes through an exhaust pipe 40 for engine 22 which, in the most preferred form of the invention, constitutes a diesel engine. In accordance with the invention, sensor 30 can be attached to exhaust pipe 40 by various suitable attachment means, such as being threadably attached to a boss (not shown) formed along exhaust pipe 40. In a manner known in the art, exhaust pipe 40 can be connected to a post or after-treatment device, such as a catalyst, diesel particulate filter (DPF) or the like (not shown). When an exhaust gas oxygen sensor is employed in combination with a catalytic converter, the exhaust gas oxygen sensor is mounted before the converter. In any case, sensor 30 can be located before, between portions of or after the after-treatment device. As depicted, sensor 30 includes a sensor body 302 through which a bore 304 extends. A gas inlet tube 306 is arranged in fluid communication with valve 28 and extends into bore 304. Sensor 30 also includes a sensing element 308 which projects from sensor body 302 and is electrically coupled to controlling unit (ECU) 32. A protective cap 310 extends about both sensing element 308 and bore 304.

In accordance with the invention, sensing element 308 can take any shape, including planar or cylindrical. Sensing element 308 is preferably made of a ceramic material, but other known materials could be used. Furthermore, sensing element 308 may be heated, enabling sensing element 308 to be at a high enough temperature where exhaust soot is oxidized or vaporized Lastly, as indicated above, sensing element 308 can constitute an oxygen, a $NO_x$, or any other type of exhaust gas sensor. Again, the most preferred form of the invention employs sensor 30 in combination with a diesel or other lean-burning combustion engine.

Protective cap 310 is actually coupled to sensor body 302 and encapsulates sensing element 308 so as to define a sensor calibration chamber 314. Protective cap 310 is provided with a plurality of openings, such as holes or slots 312, that control exhaust gas flow through sensor 30 as indicated by the flow lines in FIG. 2. Slots 312 are of a size that reduce the possibility of debris and water droplets impacting sensing element 308, while still enabling exhaust gas to travel through sensor calibration chamber 314.

During normal operation of vehicle 10, sensor 30 functions to sense the concentration of a predetermined gas in the exhaust flow by allowing the exhaust to flow through slots 312 of protective cap 310 and into sensor calibration chamber 314. When the exhaust enters chamber 314, sensing element 308 sends a signal to controlling unit 32 indicative of a concentration of the gas in the exhaust stream. Left with only its initial calibration, the measured concentrations from sensor 30 will tend to drift over time such that the accuracy of the readings is diminished. To counter this problem, controlling unit 32 periodically activates or otherwise opens valve 28 which causes sensor 30 to receive a stream of gas of known concentration. During this time period, controlling unit 32 compares signals from sensor 30 with predetermined values for the known concentration and sensor 30 is re-calibrated. More specifically, a modified corrective factor is established for subsequent readings taken by sensor 30 to improve overall sensing accuracy. Although the invention is not limited in this respect, preferably, a zero calibration of sensor 30 is performed with the use of air as the gas of known concentration, without the presence of $NO_x$, HC, water and $NH_3$. Zero calibration in accordance with the invention is seen to be particularly advantageous in connection with $NO_x$ sensors and is also considered to be useful for $NH_3$ sensors. In any case, with this self-calibrating arrangement, sensor 30 is able to render accurate readings even as it ages.

If booster 24 is coupled directly with valve 28, then calibration preferably occurs when there is enough power for booster 24 to generate a supplement flow of pressurized gas. However, if reservoir 36 is used, the calibration gas (air in this case) may be stored in reservoir 36 through the use of valves 28 and 37, thereby enabling a calibration operation to be performed even when the flow of air through booster 24 is low or engine 22 is not even running. The use of an air pump also makes available a wide range of calibration periods. In any case, if sufficient pressure exists, sensor 30 may be calibrated while vehicle 10 is moving or when engine 22 is idle. When calibration is desired, controlling unit 32 opens valve 28 to cause pressurized fluid having a known gas concentration to be delivered through gas inlet tube 306 to completely fill sensor calibration chamber 314 for a calibration period. That is, the pressurized gas of the known concentration supplied from valve 28, either directly from booster 24 or optional reservoir 36, flows into gas inlet tube 306 and then into sensor calibration chamber 314, thereby forcibly displacing any prior exhaust gas in sensor calibration chamber 314. Sensing element 308 then measures the concentration of the gas, with the measurement signals being sent to controlling unit 32. Controlling unit 32 compares the measurement of the concentration of the gas with the known concentration and calibrates sensor 30 accordingly. By way of example, if sensing element 308 is a $NO_x$ sensor and pressurized air is supplied to sensor calibration chamber 314, then zero calibration can be readily established based on an amount of $O_2$ sensing element 308 detects that deviates from 21% $O_2$.

In further accordance with the present invention, controlling unit 32 may also be programmed to allow pressurized air to flow through sensor 30 during a cold start and until the exhaust is warm. This aspect of the invention is employed to eliminate the potential danger of having water droplets directly contact sensing element 308.

Based on the above, it should be readily apparent that the present invention advantageously enables an exhaust gas sensor to be automatically self-calibrated to remain highly sensitive throughout its operational life, thereby increasing system accuracy. By providing a self-calibration system that can be employed during operation of the vehicle, calibration can be performed without vehicle operators being burdened with time consuming service requirements. Although described with reference to preferred embodiments of the invention, it should be readily understood that various changes and/or modifications can be made to the invention without departing from the spirit thereof. For example, as mentioned above, one or more self-calibrating sensors may be used in the exhaust path. While FIG. 2 illustrates the use of a single protective cap, multiple overlapping protective caps may be used. Moreover, any pressurized gas could be fed to the self-calibrating sensor, either by service technicians during routine maintenance, pre-charging the reservoir with a desired gas or even incorporating an air pump (not shown) controlled by the electronic controlling unit to supply air when the engine is turned off. Finally, it should be realized that the system could actually be used to determine a range of calibrating points. In general, the invention is only intended to be limited by the scope of the following claims.

The invention claimed is:

1. A vehicle comprising:

an engine;

a booster having an air inlet for drawing air into the booster and an air outlet for directing air to the engine;

an exhaust establishing an exhaust passage for guiding products of combustion away from the engine; and a self-calibrating sensor system including:

an exhaust gas sensor extending into the exhaust passage for sensing a concentration of a predetermined gas, said exhaust gas sensor including: a body provided with a bore; a sensing element projecting from the body into the exhaust passage; a cap member extending into the exhaust passage and establishing a sensor calibration chamber in which the sensing element projects, said cap member including a plurality of openings for permitting the products of combustion to enter the sensor calibration chamber; and a gas inlet tube extending into the bore and being fluidly exposed to the sensor calibration chamber;

a valve interposed between a supply of fluid containing the predetermined gas at a known concentration and both the gas inlet tube and the sensor;

a controlling unit for regulating the valve, wherein, during operation of the vehicle, the sensor element of the exhaust gas sensor is exposed to the concentration of the predetermined gas flowing through the exhaust passage and, during a period of sensor self-calibration, the controlling unit shifts the valve to cause the exhaust gas sensor to be exposed to the supply of fluid containing the predetermined gas at the known concentration.

2. A system for a vehicle comprising:

an engine;

an exhaust establishing an exhaust passage for guiding products of combustion away from the engine; and a self-calibrating sensor system including:

an exhaust gas sensor extending into the exhaust passage for sensing a concentration of a predetermined gas; and a controlling unit, wherein, during operation of the vehicle, the exhaust gas sensor is exposed to the concentration of the predetermined gas flowing through the exhaust passage and, during a period of sensor self-calibration, the controlling unit causes the exhaust gas sensor to be exposed to a supply of fluid containing a predetermined gas at a known concentration.

3. The system of claim 2, wherein the self-calibrating sensor system further includes a valve interposed between the supply of fluid containing the predetermined gas at the known concentration and the exhaust gas sensor, said controlling unit shifting the valve to cause the exhaust gas sensor to be exposed to the supply of fluid.

4. The system of claim 3, further comprising: a booster having an air inlet for drawing air into the booster and an air outlet for directing air to the engine.

5. The system of claim 4, wherein the valve is interposed between the air outlet of the booster and the sensor.

6. The system of claim 5, wherein the booster is selected from the group consisting of a supercharger and a turbocharger.

7. The system of claim 3, further comprising: a reservoir fluidly connected to the valve and storing the supply of fluid containing the predetermined gas at the known concentration.

8. The system of claim 2, wherein the exhaust gas sensor includes a sensing element protruding into the exhaust passage and a cap member extending about the sensing element, said cap member having a plurality of openings for permitting the sensing element to be exposed to the products of combustion.

9. A self-calibrating sensor system including:

an exhaust gas sensor adapted to extend into an exhaust passage of a vehicle for sensing a concentration of a predetermined gas, said exhaust gas sensor including: a body provided with a bore; a sensing element projecting from the body; a cap member establishing a sensor calibration chamber in which the sensing element projects, said cap member including a plurality of openings for permitting products of combustion to enter the sensor calibration chamber; and a gas inlet tube extending into the bore and being fluidly exposed to the sensor calibration chamber; and a controlling unit for, during a period of sensor self-calibration, cause the exhaust gas sensor to be exposed to a supply of fluid containing a predetermined gas at a known concentration.

10. The sensor system of claim 9, further comprising: a valve interposed between the supply of fluid containing the predetermined gas at the known concentration and the gas inlet tube, said controlling unit shifting the valve to cause the exhaust gas sensor to be exposed to the supply of fluid.

11. The sensor system of claim 10, further comprising: a reservoir fluidly connected to the valve and storing the supply of fluid containing the predetermined gas at the known concentration.

12. The sensor system of claim 9, wherein the plurality of openings in the cap member are constituted by spaced slots.

13. A method for operating an exhaust gas sensor in a vehicle comprising:

operating the vehicle such that a sensing element of the exhaust gas sensor is exposed to products of combustion in an exhaust passage for an engine of the vehicle, with the exhaust gas sensor providing signals of a concentration level of a predetermined gas flowing through the exhaust passage; and performing self-calibration of the exhaust gas sensor by exposing the sensing element to a supply of fluid containing the predetermined gas at a known concentration.

14. The method of claim 13, further comprising: comparing gas concentration signals received from the exhaust gas sensor with the known concentration, and establishing a corrective factor for concentration signals received from the exhaust gas sensor.

15. The method of claim 14, further comprising: receiving the supply of fluid containing the predetermined gas at the known concentration from a booster for the engine.

16. The method of claim 15, further comprising: opening a valve between the booster and the exhaust gas sensor to expose the sensing element to the supply of fluid.

17. The method of claim 13, wherein the self-calibration is performed while the engine of the vehicle is running.

18. The method of claim 13, further comprising: receiving the supply of fluid containing the predetermined gas at the known concentration from a reservoir provided on the vehicle.

19. The method of claim 13, further comprising: directing the products of combustion through openings formed in a cap member of the sensor in order to expose the sensing element during operation of the vehicle.

20. The method of claim 19 wherein, during self-calibration, the supply of fluid containing the predetermined gas at the known concentration is delivered into a calibration chamber formed by the cap member, with the supply of fluid containing the predetermined gas at the known concentration forcibly displacing products of combustion within the calibration chamber.

* * * * *